US005743380A

United States Patent [19]

Gauker

[11] Patent Number: 5,743,380

[45] Date of Patent: Apr. 28, 1998

[54] ROTARY DOOR LOCK SWITCH ASSEMBLY AND METHOD FOR MANUFACTURING SAME

[75] Inventor: Bradford K. Gauker, Clinton Township, Mich.

[73] Assignee: Augat Inc., Mansfield, Mass.

[21] Appl. No.: 759,113

[22] Filed: Dec. 2, 1996

[51] Int. Cl.[6] ..... H01H 27/06

[52] U.S. Cl. ..... 200/43.08; 200/571; 200/570

[58] Field of Search ..... 200/43.08, 564, 200/567, 570, 571, 11 R, 14, 116, 336, 293; 70/DIG. 30

[56] References Cited

U.S. PATENT DOCUMENTS

| | | | |
|---|---|---|---|
| 2,503,287 | 4/1950 | Moore | 200/60 |
| 3,188,881 | 6/1965 | Pusch | 74/504 |
| 3,583,185 | 6/1971 | Jacobi | 70/455 |
| 3,593,816 | 7/1971 | Kazaoka | 180/113 |
| 3,602,019 | 8/1971 | Kazaoka | 70/264 |
| 3,630,305 | 12/1971 | Kazaoka | 180/113 |
| 3,676,617 | 7/1972 | Miller | 200/44 |
| 3,695,381 | 10/1972 | Okada et al. | 180/112 |
| 3,697,945 | 10/1972 | Comber | 340/64 |
| 3,714,628 | 1/1973 | Sloger | 340/64 |
| 3,722,615 | 3/1973 | Okadea et al. | 180/112 |
| 3,764,859 | 10/1973 | Wood et al. | 317/134 |
| 3,793,500 | 2/1974 | Gerber | 200/44 |
| 3,873,891 | 3/1975 | Gerber | 317/134 |
| 3,878,346 | 4/1975 | Green | 200/43 |
| 3,941,955 | 3/1976 | Gerber | 200/44 |
| 3,967,479 | 7/1976 | Vick | 70/276 |
| 3,983,354 | 9/1976 | Gammie et al. | 200/155 R |
| 3,996,432 | 12/1976 | Sikora | 200/44 |
| 4,099,593 | 7/1978 | Schultz | 180/114 |
| 4,189,712 | 2/1980 | Lemelson | 340/149 A |
| 4,200,227 | 4/1980 | Lemelson | 235/382 |
| 4,272,112 | 6/1981 | Schlick et al. | 292/201 |
| 4,280,349 | 7/1981 | Grabner et al. | 70/358 |
| 4,354,189 | 10/1982 | Lemelson | 340/825.31 |
| 4,437,137 | 3/1984 | Mochida | 361/172 |
| 4,453,161 | 6/1984 | Lemelson | 340/825.31 |
| 4,553,006 | 11/1985 | Little | 200/43.05 |
| 4,744,231 | 5/1988 | Takagi et al. | 70/264 |
| 4,762,348 | 8/1988 | Matsumoto | 292/201 |
| 4,779,912 | 10/1988 | Ikeda et al. | 292/336.3 |
| 4,787,223 | 11/1988 | Gotanda | 70/264 |
| 4,841,758 | 6/1989 | Ramblier | 70/276 |
| 4,904,006 | 2/1990 | Hayakawa et al. | 292/336.3 |
| 4,934,746 | 6/1990 | Yamada | 292/201 |
| 4,936,122 | 6/1990 | Osada | 70/214 |
| 4,953,420 | 9/1990 | Krubsack et al. | 70/366 |
| 4,963,122 | 10/1990 | Ryan | 475/184 |
| 4,986,098 | 1/1991 | Fisher | 70/262 |
| 5,162,625 | 11/1992 | Comerford | 200/61.89 |

*Primary Examiner*—David J. Walczak

*Attorney, Agent, or Firm*—Weingarten, Schurgin, Gagnebin & Hayes LLP

[57] ABSTRACT

A three-position rotary door lock switch assembly for automobiles is provided. The switch assembly includes a rotor with reversely curved rotor contact beams having a dual radiussed contact zone with upturned edges which provide good contact and minimize gouging or grooving of the associated stator contacts. The switch assembly also includes a housing assembly sealed to keep out environmental contaminants and moisture. Additional sealing is provided at the area where the wires enter the assembly between the housings and the rotor.

18 Claims, 15 Drawing Sheets

FIG. 10
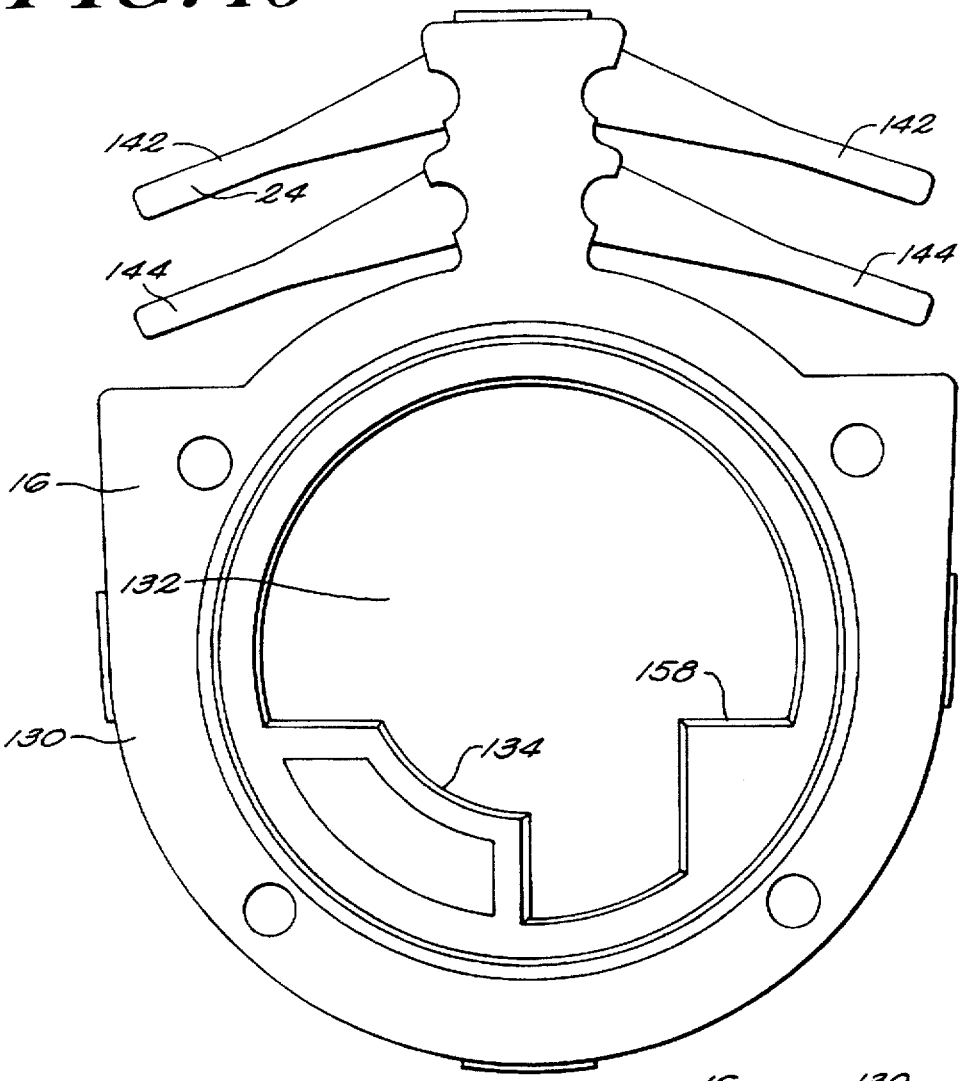
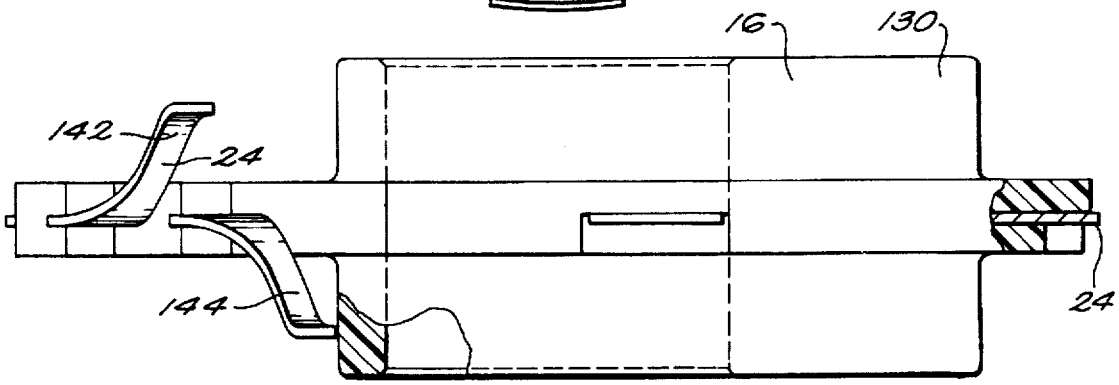
FIG. 11

ROTARY DOOR LOCK SWITCH ASSEMBLY AND METHOD FOR MANUFACTURING SAME

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Rotary door lock switches operable with keys are typically provided in passenger side and driver side doors of automobiles or other vehicles. In three-position switches, the key can be turned both clockwise or counterclockwise to operate different functions in addition to locking or unlocking the door. For example, such switches are used to activate or deactivate a central locking system, an anti-theft system, or interior lighting.

Such switches must be sealed against environmental contaminants and water. Water can enter lock switch assemblies from humid air, rain, or a car wash. A typical three-position switch is sealed by providing a coating of epoxy around the outside of the housing. However, the epoxy coating is irregular in shape and can interfere with assembly of the switch among the closely packed components in the lock assembly or in the door panel. Also, a crack formed in the epoxy can let moisture leak in. Applying the epoxy coating also requires an additional step in the manufacturing process. Typical prior art rotary switches also include contact beams which are merely bent along a line to bring them into contact with an associated contact, as indicated in FIG. 23.

BRIEF SUMMARY OF THE INVENTION

The present invention provides a rotary door lock switch for automobiles or other vehicles sealed to keep out environmental contaminants and moisture from rain, humidity, or other sources. The rotary door lock switch includes a first housing, which may be an inner or outer housing, and a second housing, which may be an outer or an inner housing, depending on the first housing. The housings are formed of a dielectric insulative material and sonically welded at a peripheral seam or joint to form a seal. The housings include first and second arcuate contacts which are overmolded into the housings. A rotor formed of a rotor body carrying a rotor contact is disposed inside of the housings for rotation with respect to the housing contacts. The rotor body is formed of a dielectric insulative material which preferably differs from the dielectric insulative material of the housings to minimize the possibility of sonically welding the rotor to the housings. The housings include first and second wire towers in which wire grips of the housing contacts are disposed. Wires in the wire grips are encapsulated in the wire towers during molding to provide a good seal at the wire entrance area as well. First and second O-rings are provided between the rotor and the housings. The O-rings are located in recessed areas which place the O-rings in positive displacement when the switch is assembled, further improving the sealing.

The rotor contact comprises two pairs of beams disposed to contact associated ones of the contacts on the contact paths. The contact beams include dual radiussed tips for improved electrical contact with the contacts. The edges of the tips are upturned to prevent gouging of the contacts. The beams are also reversely curved to provide a more uniform contact force on the contacts.

BRIEF DESCRIPTION OF THE SEVERAL VIEWS OF THE DRAWINGS

The invention will be more fully understood from the following detailed description taken in conjunction with the accompanying drawings in which:

FIG. 10 is a top plan view of the rotor of the rotary door lock switch;

FIG. 11 is a partially broken side view of the rotor of FIG. 10;

DETAILED DESCRIPTION OF THE INVENTION

Figure 1:
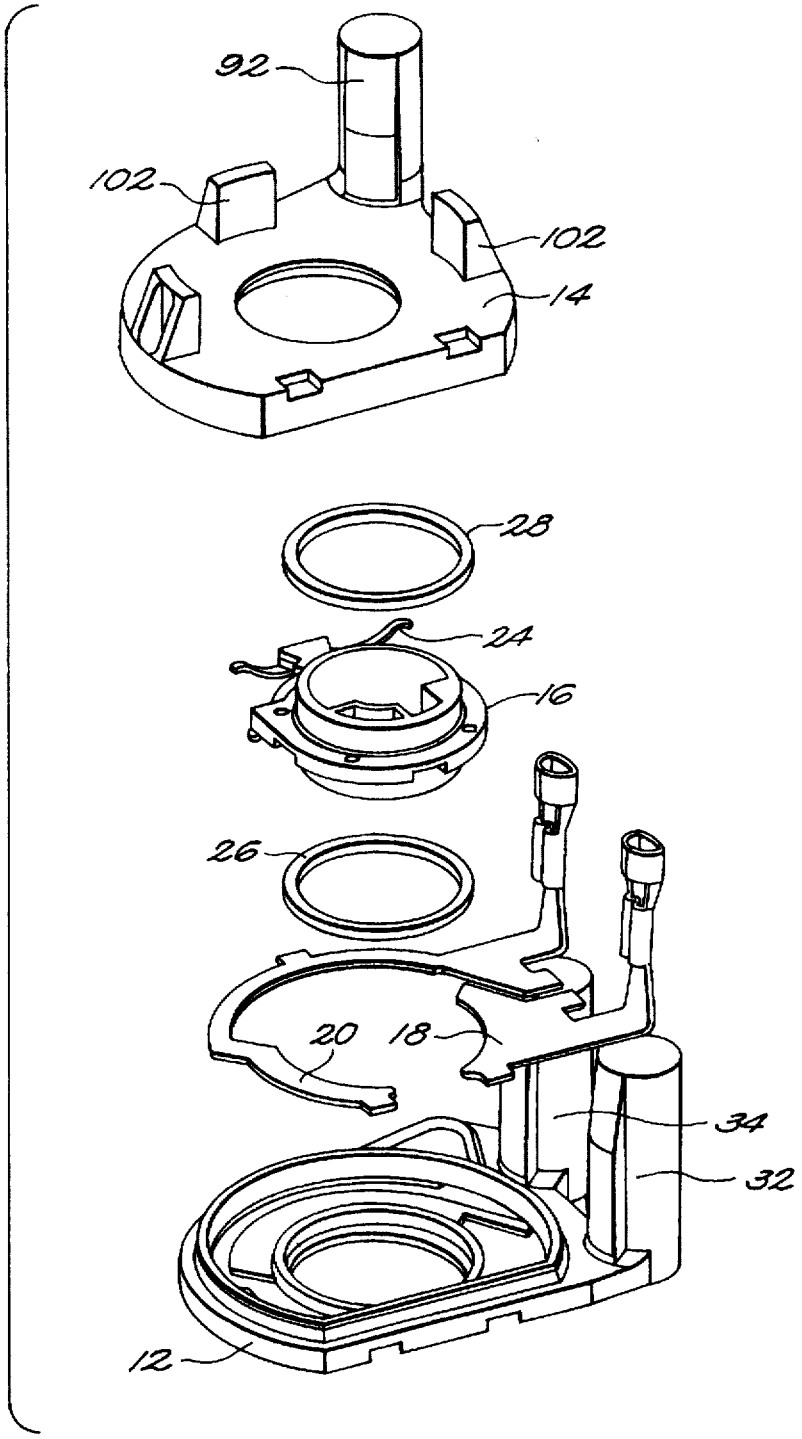
FIG. 1 is an exploded perspective view of a rotary door lock switch of the present invention.
Figure 2:
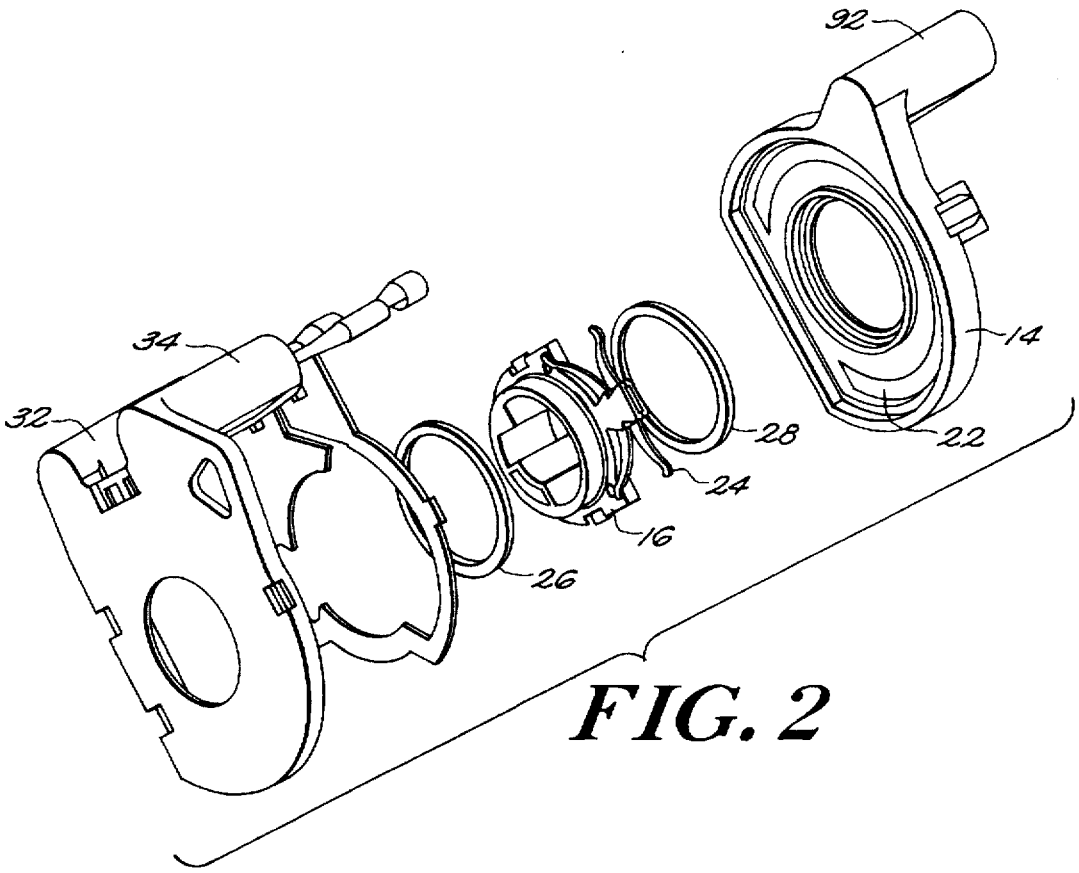
FIG. 2 is another exploded perspective view of the rotary door lock switch of FIG. 1.
Figure 3:
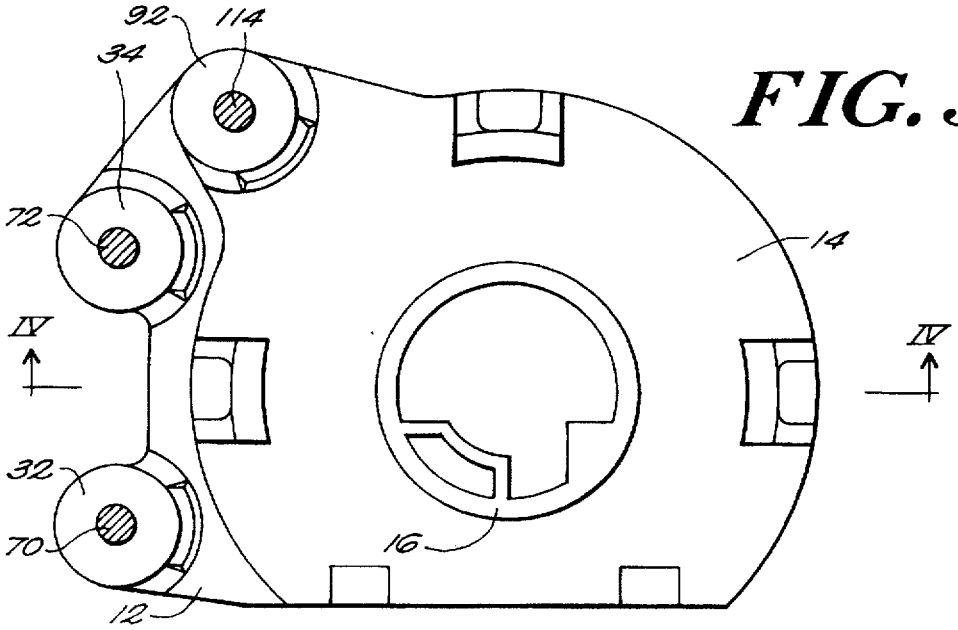
FIG. 3 is a top plan view of the assembled rotary door lock switch.

Referring to FIGS. 1 through 4, the rotary door lock switch includes an inner housing 12, an outer housing 14, and a rotor 16 or hub. The inner housing and outer housing are formed of a dielectric insulative material. Two inner contacts 18, 20 are overmolded into the inner housing and an outer contact 22 is overmolded into the outer housing. A rotor contact 24 is overmolded into a rotor body, also formed of a dielectric insulative material, of the rotor. An O-ring 26 is provided between the rotor and the inner housing and another O-ring 28 is provided between the rotor and the outer housing. The switch is provided in right-handed and left-handed, or driver's side and passenger's side, versions. Each version is identical other than in orientation, so only one version is described in detail in the following description.

Figure 5:
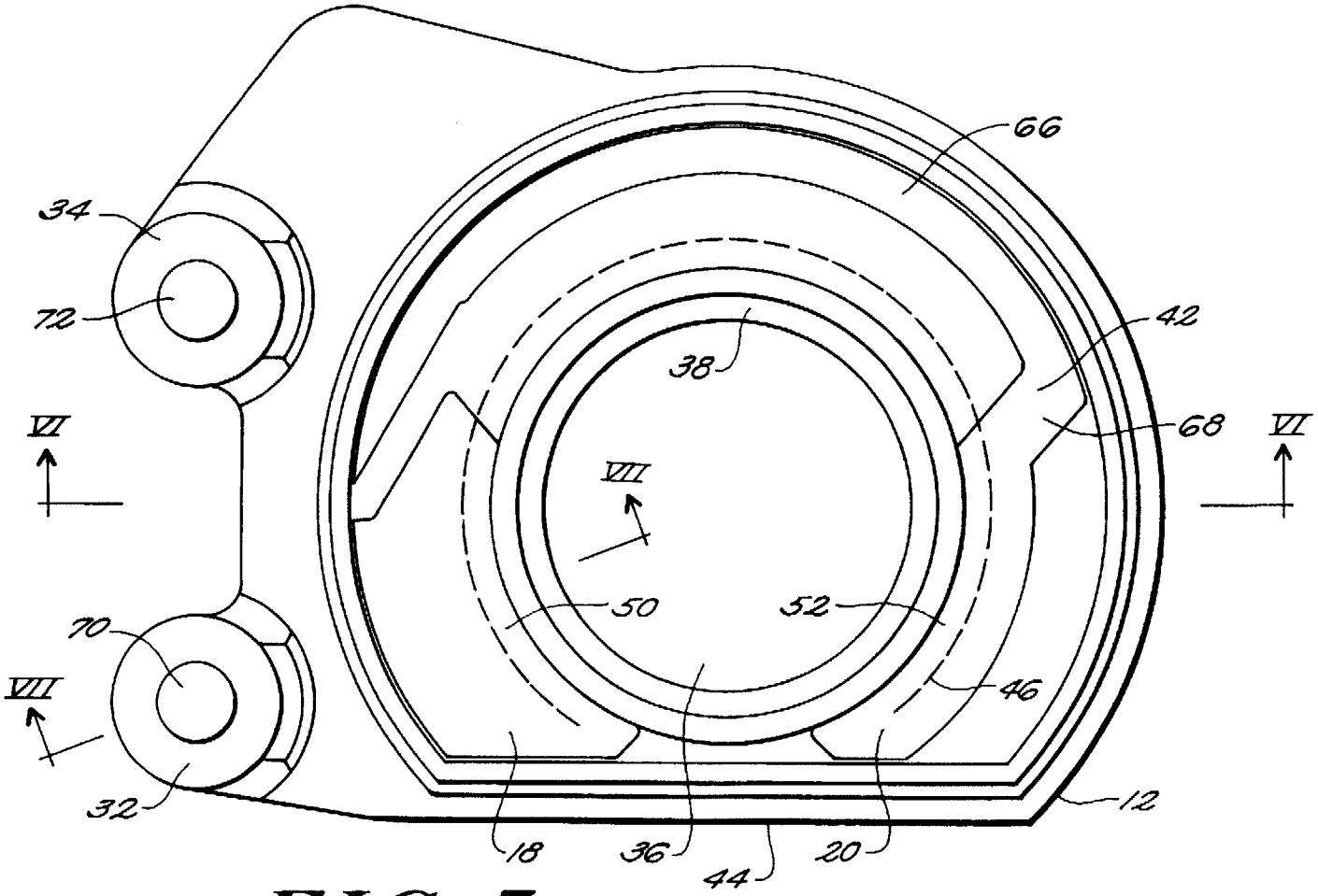
FIG. 5 is a top plan view of the inner housing of the rotary door lock switch.
Figure 6:
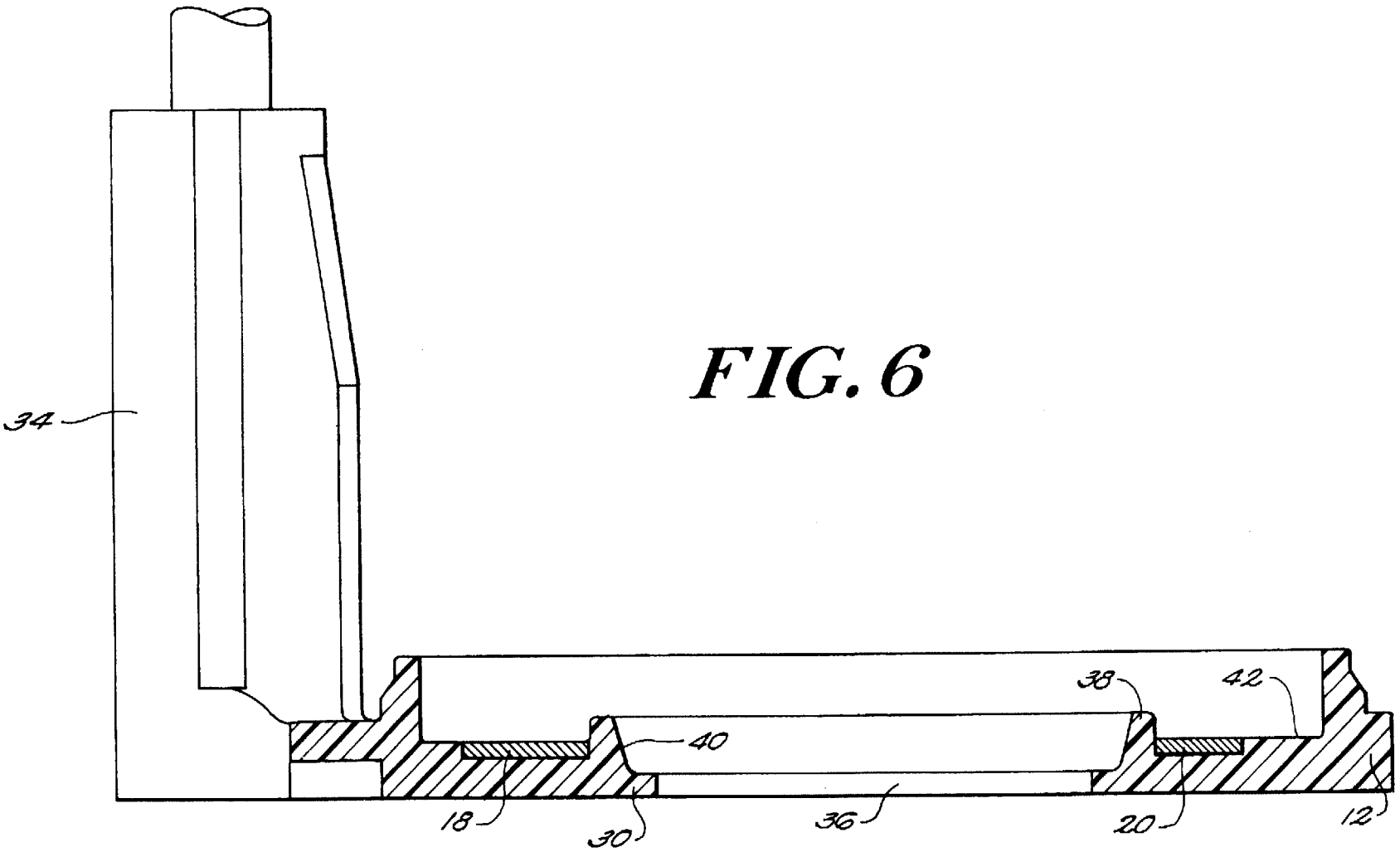
FIG. 6 is a cross section along line VI—VI of FIG. 5.
Figure 7:
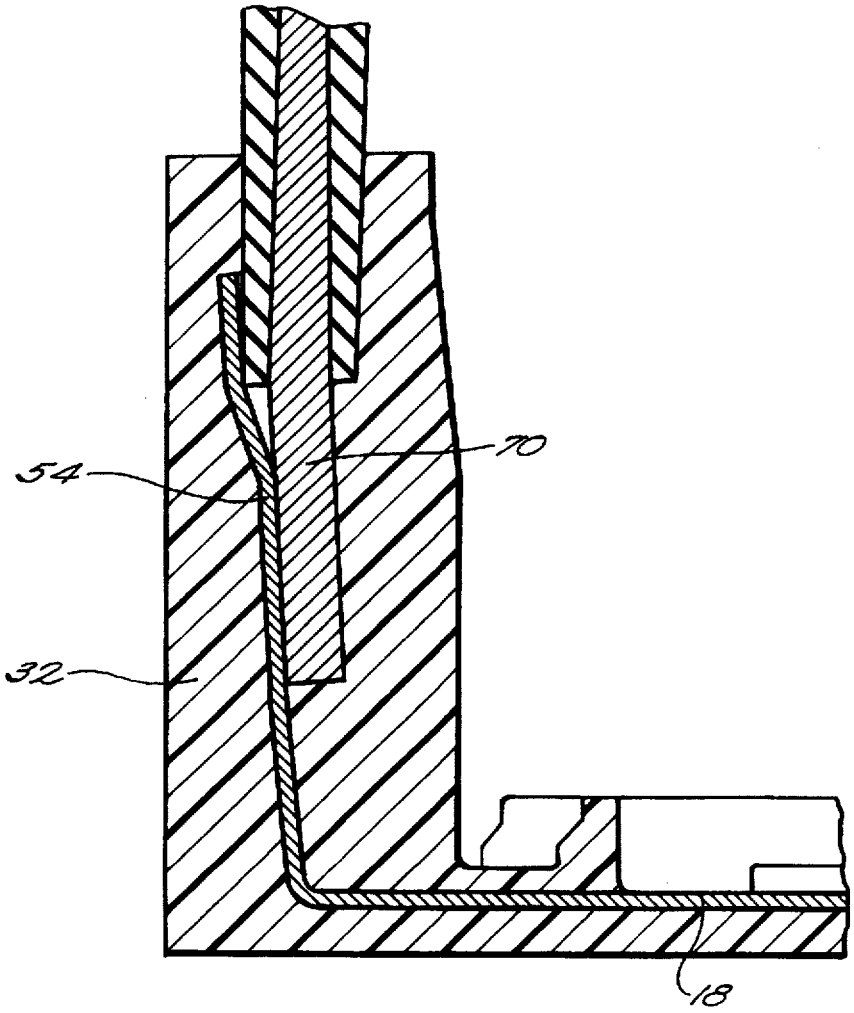
FIG. 7 is a cross section along line VII—VII of FIG. 5.

Referring more particularly to FIGS. 5, 6, and 7, the inner housing 12 also includes a plate-like stator member 30 integrally formed with two upstanding wire towers 32, 34. A central through opening 36 surrounded by an upstanding annular lip 38 is formed in the stator member through which the rotor and a lock assembly (not shown) extend. An annular shoulder 40 for receiving the O-ring 26 is formed about the periphery of the central opening. An arcuate recessed area 42 is formed in the inner housing surrounding the central opening. In the embodiment illustrated, one edge 44 of the stator member is straight, which allows the switch to fit within a particular type of automobile door panel. However, the straightened edge is not critical to operation of the switch and could be omitted if desired or allowed by the components next to which the switch is assembled. The region adjacent the inner periphery of the arcuate recess defines an arcuate inner contact path, indicated schematically by the dashed line 46 in FIG. 5. The arcuate contact path must have a length sufficient to provide three switch positions as the rotor is rotated. One switch position overlies the contact 18, a second position overlies the contact 20, and a third position overlies the region along path 46 between the contacts 18 and 20.

Figure 18:
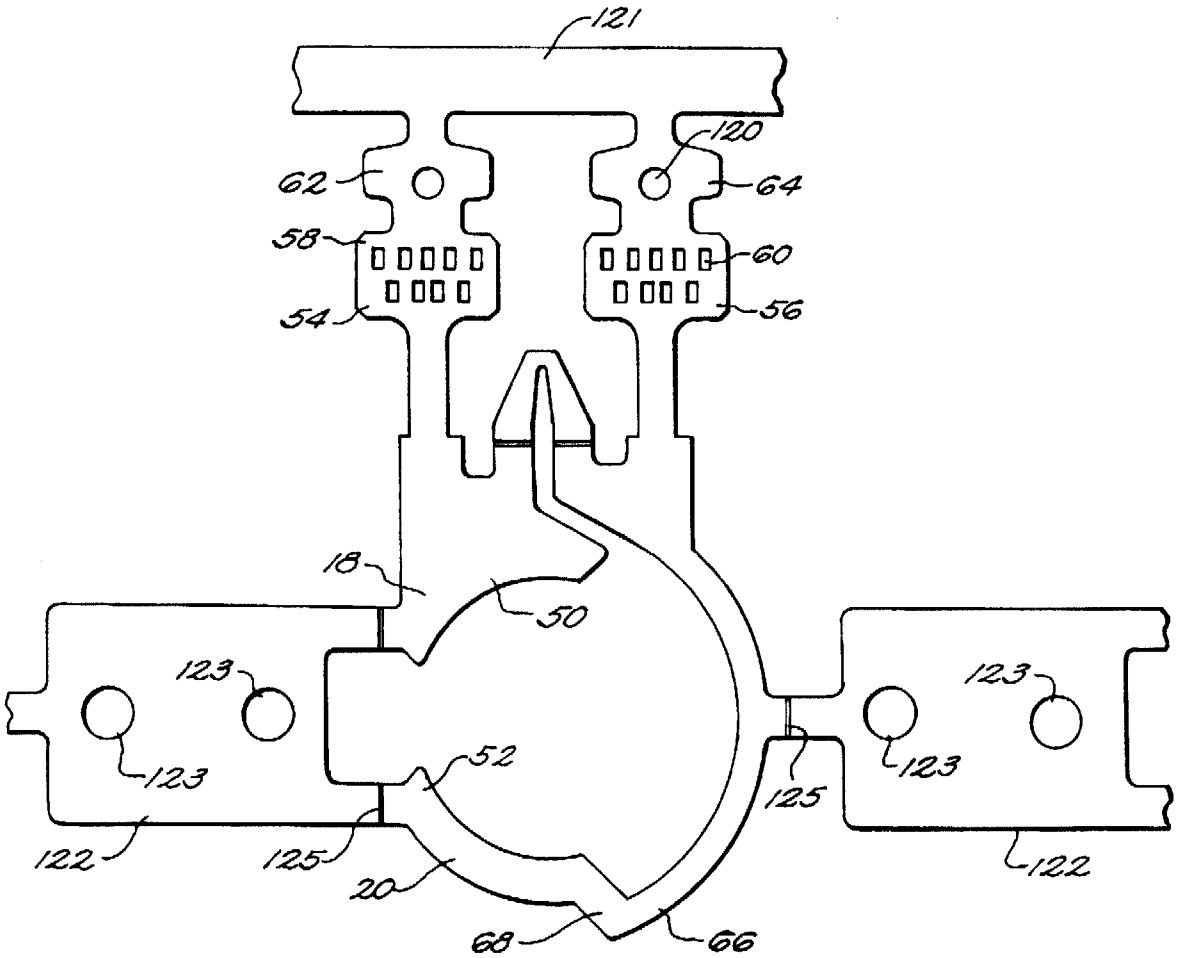
FIG. 18 is a partial view of a strip of inner contacts.

The two inner contacts, illustrated in an un assembled intermediate step in FIG. 18, each include an arcuate portion 50, 52, which forms a rotor contact pad, and an integrally formed wire grip 54, 56. The wire grip includes a wire crimp 58, 60 and an insulation crimp 62, 64 to connect to the wire for electrical communication. One of the contacts also includes an arcuate offset portion 66 which connects the contact pad and the wire grip. The offset portion is connected to the contact pad by a jog 68 which moves the inner contact out to the outer periphery of the inner housing recess, thereby displacing the offset portion from the contact path 46, such that contact cannot be made between the rotor and the offset portion.

Figure 4:
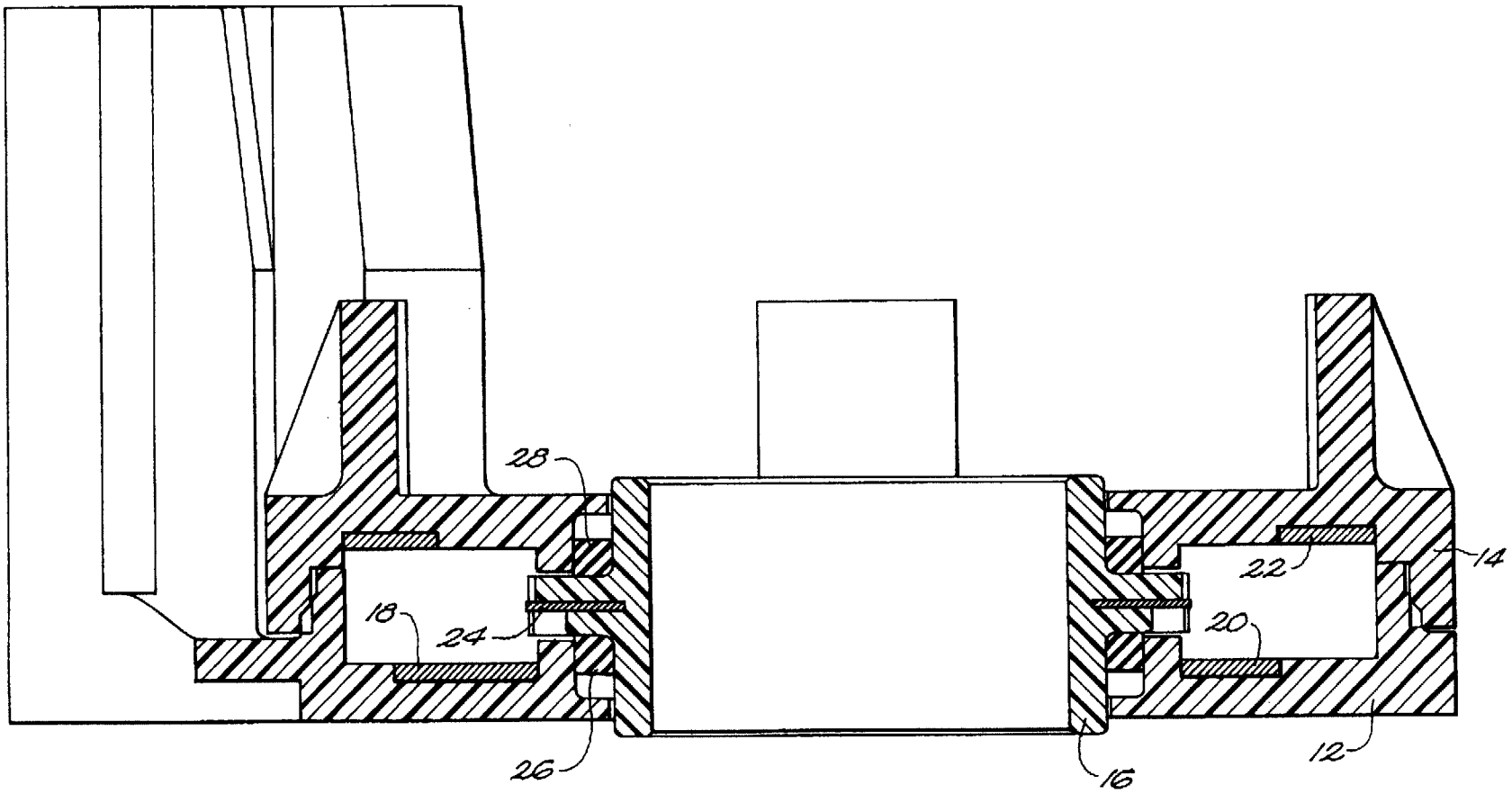
FIG. 4 is a cross section taken along line IV—IV of FIG. 3.

The inner contacts 18, 20 are overmolded into the inner housing 12 with the arcuate portions 50, 52 of each contact on the contact path 46 and each wire grip 54, 56, crimped to a wire 70, 72, within its associated wire tower 32, 34, as shown in FIG. 7 for wire tower 32. Referring to FIG. 5, the arcuate portions 50, 52 are positioned along the inner contact path 46 about the inner periphery of the recess at suitable locations to provide three switch positions, the intermediate position being one in which no contact pad is present. Thus, in the intermediate position, no electrical connection is enabled. In the embodiment illustrated, one contact pad is located adjacent one end of the straightened edge 44 and the other inner contact pad is located adjacent the other end of the straightened edge. Preferably, the arcuate portions are embedded within the inner housing such that the exposed surfaces of the arcuate portions are flush with the adjacent surface of the recess, as shown in FIGS. 4, 6, and 7, to firmly retain the inner contacts in the housing. The wire grips 54, 56 are embedded completely within the associated wire towers 32, 34 of the inner housing, as shown in FIG. 7.

Figure 8:
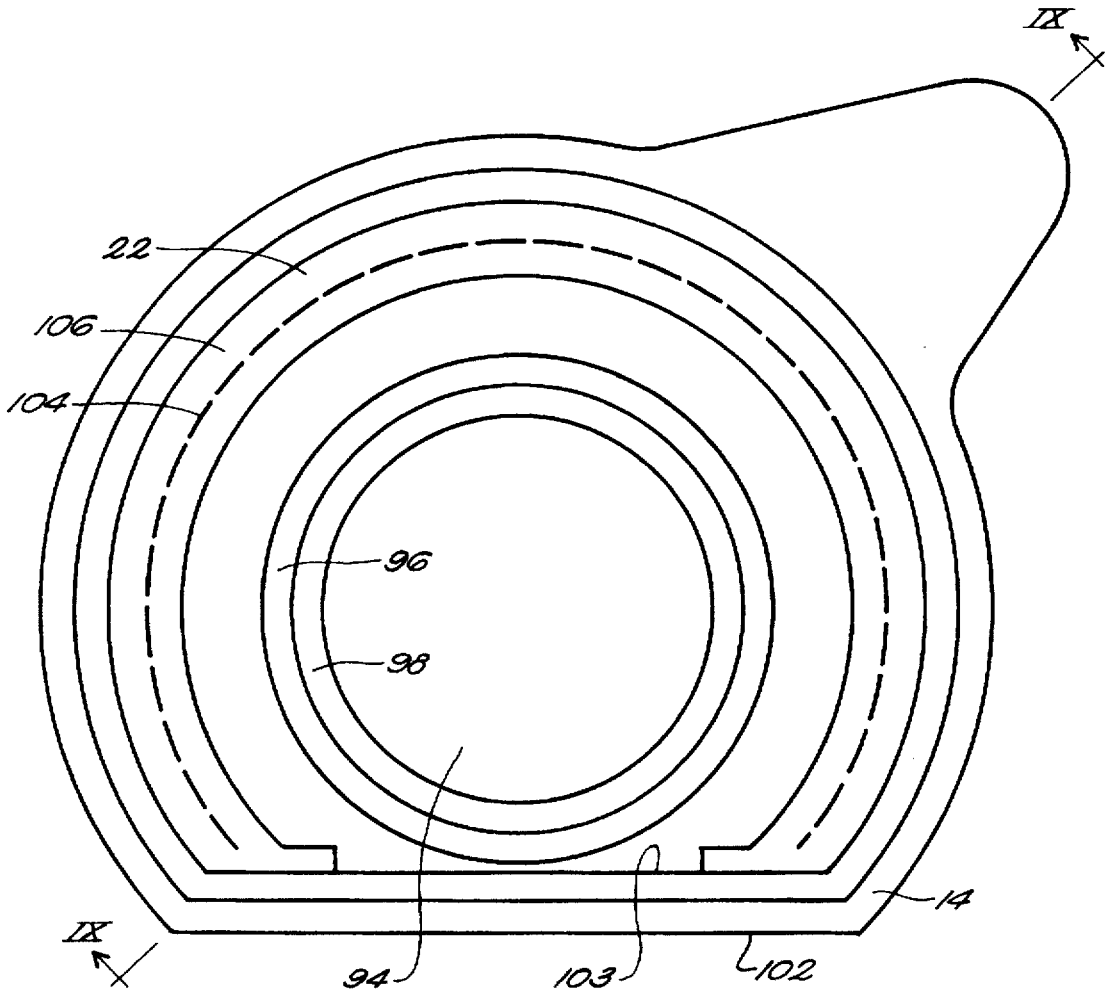
FIG. 8 is a bottom plan view of the outer housing of the rotary door lock switch.
Figure 9:
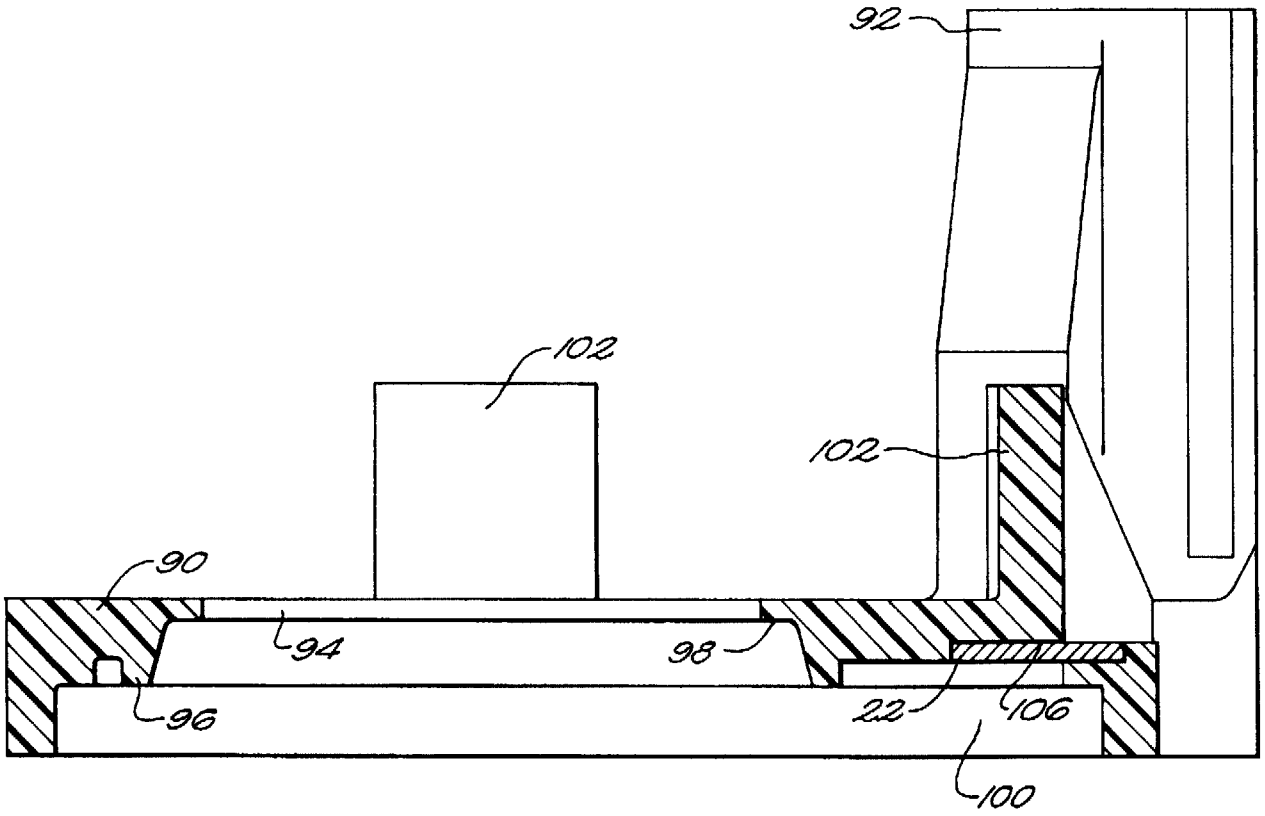
FIG. 9 is a cross section along line IX—IX of FIG. 8.

Referring more particularly to FIGS. 8 and 9, the outer housing 14 includes a plate-like stator member 90 integrally formed with an upstanding wire tower 92. A central through opening 94 surrounded by an upstanding annular lip 96 is formed in the stator member through which the rotor and the lock assembly extend. An annular shoulder 98 for receiving the O-ring 28 is formed about the periphery of the central opening. An arcuate recessed area 100 is formed in the outer housing surrounding the central opening. In the embodiment illustrated, as noted above, one edge 102 of the stator member is straight. The interior wall 103 of this straight edge acts as a stop to prevent excessive rotation of the rotor. Upstanding latching tabs 102 are formed on the outer housing to retain the assembled switch to the lock assembly. The region adjacent the outer periphery of the arcuate recess defines an arcuate outer contact path, indicated by the dashed line 104. The arcuate contact path must have a length sufficient to provide a continuous contact as the rotor is rotated.

Figure 19:
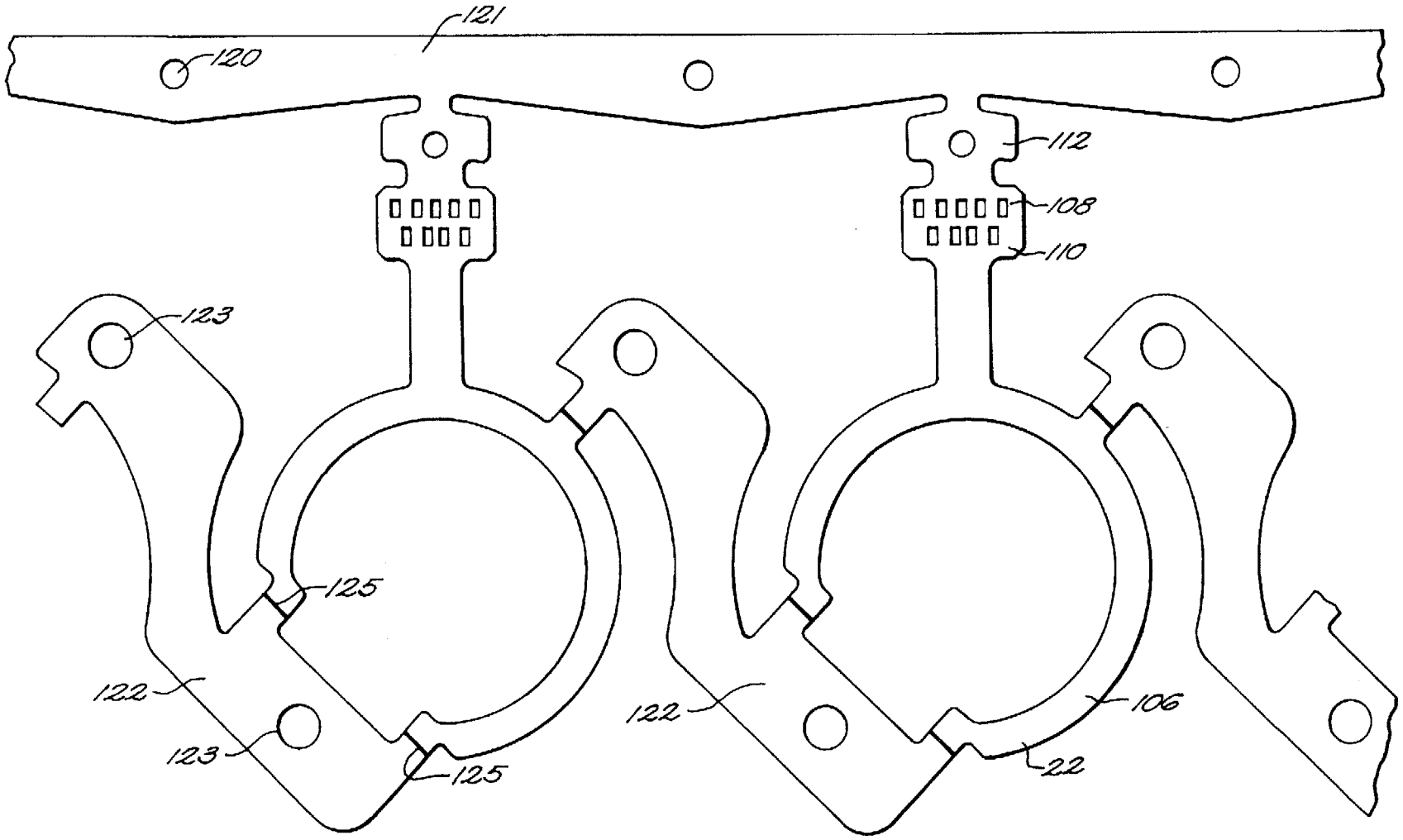
FIG. 19 is a partial view of a strip of outer contacts.

The outer contact 22, illustrated in an unassembled intermediate step in FIG. 19, includes an arcuate portion 106, which forms a rotor contact pad, and an integrally formed wire grip 108. The wire grip includes a wire crimp 110 and an insulation crimp 112 to connect to the wire for electrical communication. The outer contact is overmolded into the outer housing 14 with the arcuate portion 106 on the contact path and the wire grip 108, crimped to a wire 114, within the wire tower 92. The arcuate portion 106 extends along the outer contact path about the outer periphery of the recess a sufficient distance to provide a continuous contact. In the embodiment illustrated, the arcuate portion 106 extends from one end of the straightened edge to the other end of the straightened edge. Preferably, the arcuate portion 106 is embedded within the outer housing 14 such that the exposed surface of the arcuate portion is flush with the adjacent surface of the recess, as shown in FIGS. 4 and 9, to firmly retain the outer contact in the housing. The wire grip 108 is embedded completely within the wire tower 92 of the outer housing 14.

Figure 20:
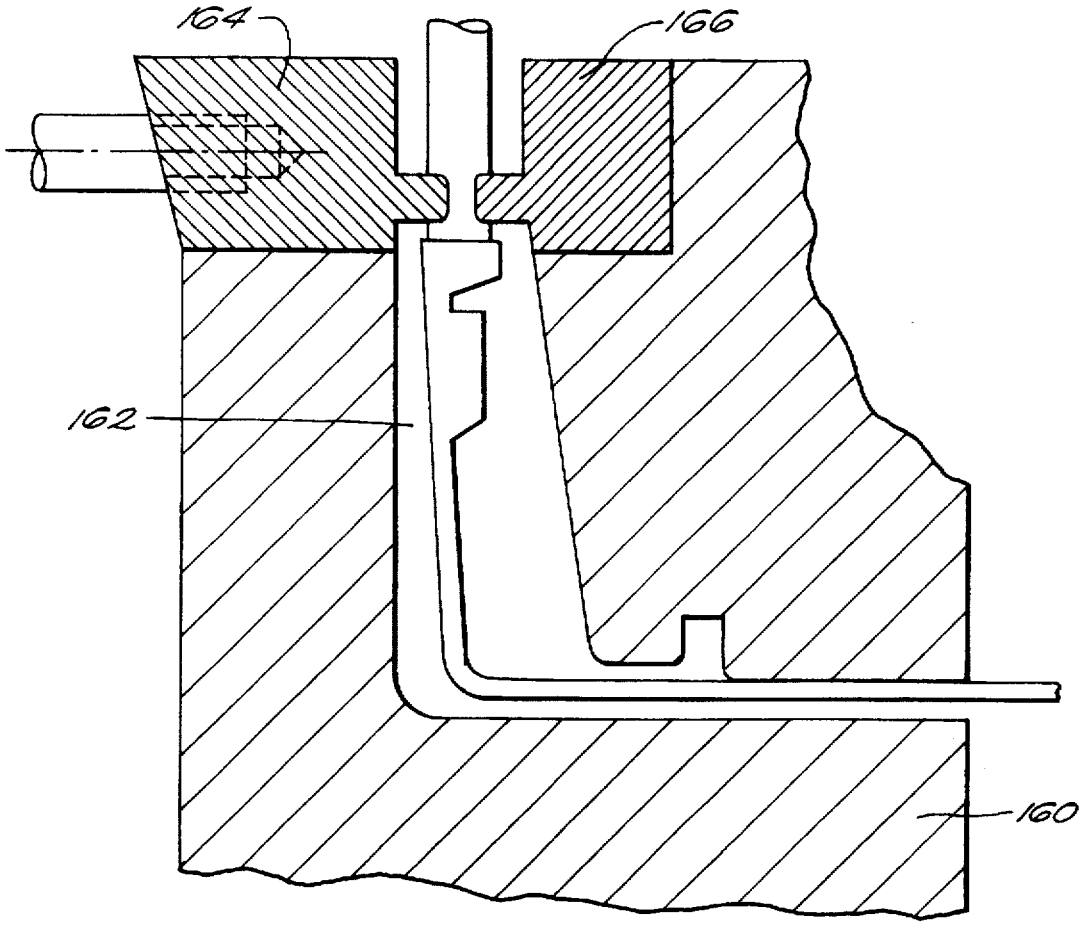
FIG. 20 is a partial cross-sectional view of a wire and terminal in a mold assembly.
Figure 21:
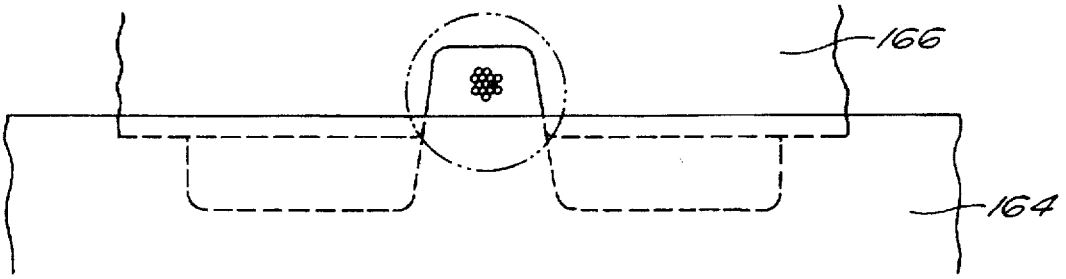
FIG. 21 is a top plan view of the mold assembly of FIG. 20.
Figure 22:
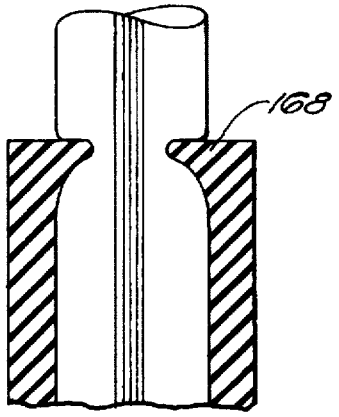
FIG. 22 is a partial cross-sectional view of the wire entrance area after molding.
Figure 23:
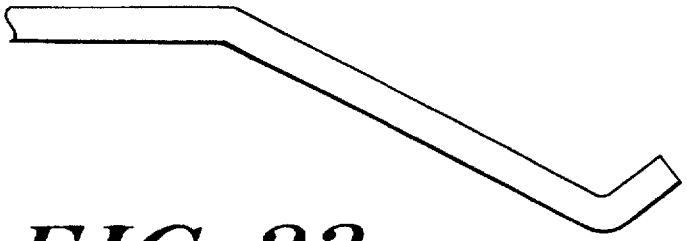
FIG. 23 (PRIOR ART)
FIG. 23 is a side view of a prior art rotor contact beam.

The inner contacts 18, 20 and outer contact 22 are stamped from continuous strips of a conductive metal, as shown in FIGS. 18 and 19. Holes 120 in a carrier strip 121 are provided at suitable locations for cooperation with equipment to transport the strip. After stamping, the sides of the wire crimps 58, 60, 110, and insulation crimps 62, 64, 112, are bent inwardly. A wire is inserted into each wire grip, and the wire crimp and insulation crimp are crimped about the wire. The contacts are separated from the carrier strip 121, which may be discarded, and adjacent contacts. The contact with the attached wire (or wires) is inserted into a mold cavity configured to receive the contact during molding of the housing, shown in FIGS. 20 and 21. Tie bars 122 with holes 123 are used to align the contact in the mold. The mold 160 includes a cavity configuration 162 which forms the wire tower (or towers). A removable mold insert or kiss off bar 164 is loaded at the top of the tower and tightened in place. The wire is pinched into a generally square cross-section, indicated in FIG. 21, between the mold insert 164 and a stationary mold element or stationary kissoff bar 166 to form a tight seal about the wire entrance area of the tower. The wire insulation is chosen to withstand the high temperatures reached in the molding process, which are typically approximately 125° C. Then, a dielectric insulating material is injected into the mold and allowed to cure. After curing, the contact is firmly embedded within the dielectric insulative material and the wire is firmly affixed in the wire tower. Referring to FIG. 22, the tight mold seal about the wire entrance area provides a necking in 168 of the wire tower about the wire, ensuring a tight seal between the wire and the wire tower such that the wire does not pull out of the wire tower and moisture and contaminants are not able to enter the wire tower. The tie bars are broken off at score lines 125.

Referring to FIGS. 10 through 14, the rotor 16 includes a generally circular rotor body 130 formed from a dielectric insulative material and a rotor contact 24 embedded within the body. The rotor includes a central through opening 132 through which a shaft of the locking assembly extends. In assembly, the rotor rests within the openings 36, 94 of the inner and outer housings. The O-rings 26, 28 placed within the shoulders 40, 98 formed in the openings of the housings 12, 14 seal the rotor within the housings. The rotor body 130 includes an attachment element 134 which connects to the shaft of the locking assembly (not shown) such that rotation of the locking assembly causes a corresponding rotation of the rotor with respect to the inner and outer housings.

Figure 12:
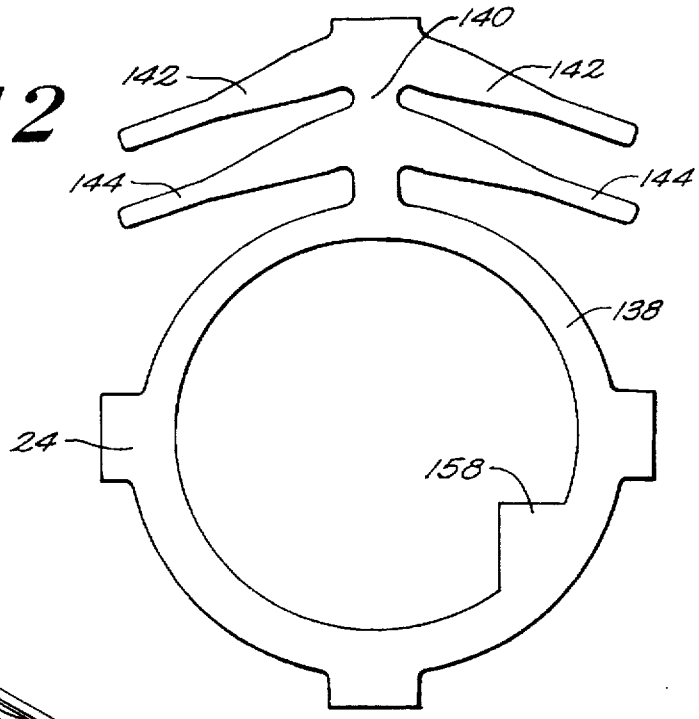
FIG. 12 is a rotor contact of the rotor.

The rotor contact 24 includes a circular portion 138 and a support arm 140 which are embedded within the rotor body in the assembled condition. A pair of outer rotor contact beams 142 and a pair of inner rotor contact beams 144 extend from opposite sides of the support arm 140. The outer rotor contact beams 142 are angled upwardly to contact the outer contact path 104 in the outer housing at the contact zone, and the inner rotor contact beams 144 are angled downwardly to contact the inner contact path in the inner housing at the contact zone. All the contact beams are angled backwardly, as indicated in FIGS. 10 and 12, to align the contact zones to the curvature of their respective housing contact paths.

Figure 17:
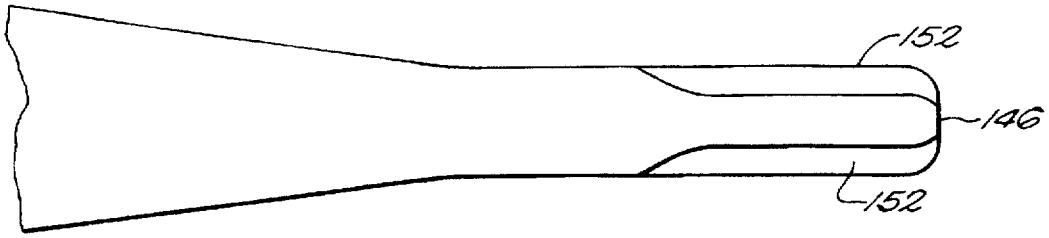
FIG. 17 is a top plan view of the beam of FIG. 15.
Figure 15:
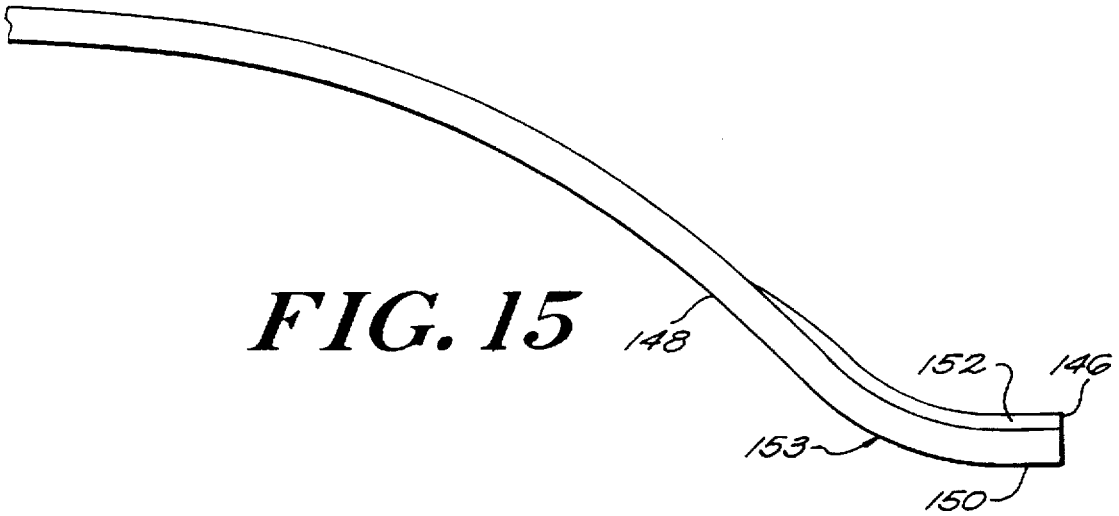
FIG. 15 is a side view of a beam of the rotor contact.
Figure 16:
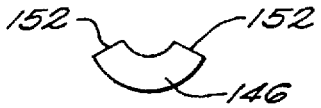
FIG. 16 is an end view of the beam of FIG. 15.

The contact beams 142, 144, which are identical, are described with reference to FIGS. 15–17, which depicts a single beam. The beam extends from the support arm and is bent in a plane perpendicular to the planes of the contact paths with a first lengthwise curvature downwardly or upwardly toward its associated contact path, as seen in FIG. 15. Approaching the end 146 of the beam, the lengthwise curvature reverses at an inflection point 148 and terminates in a flat portion 150, which is angled slightly away from the associated contact path. The edges 152 of the beam are also bent away from the contact path to provide a transverse curvature, indicated in FIG. 16, for a distance extending from the end of the beam inwardly preferably to a point beyond the inflection point, indicated in FIGS. 15 and 17. The beam contacts its associated contact path at a location within a contact zone 153 located just rearwardly of the flat portion 150. The contact zone is dual radiussed; that is, it is curved in two directions, provided by the lengthwise curvature and the transverse curvature of the beam. The dual radiussed contact zone ensures a good contact between the beam and the associated contact. The upturned edges of the transverse curvature also prevent the beam from gouging a channel along the contact path, either in the contact or in the housing.

Figure 13:
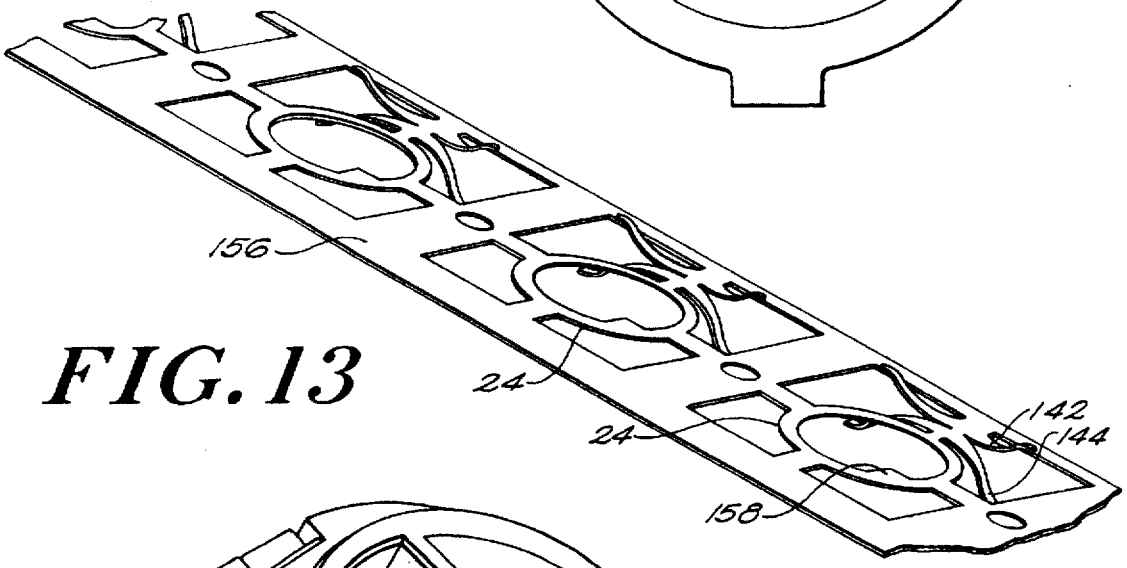
FIG. 13 is a strip of rotor contacts.
Figure 14:
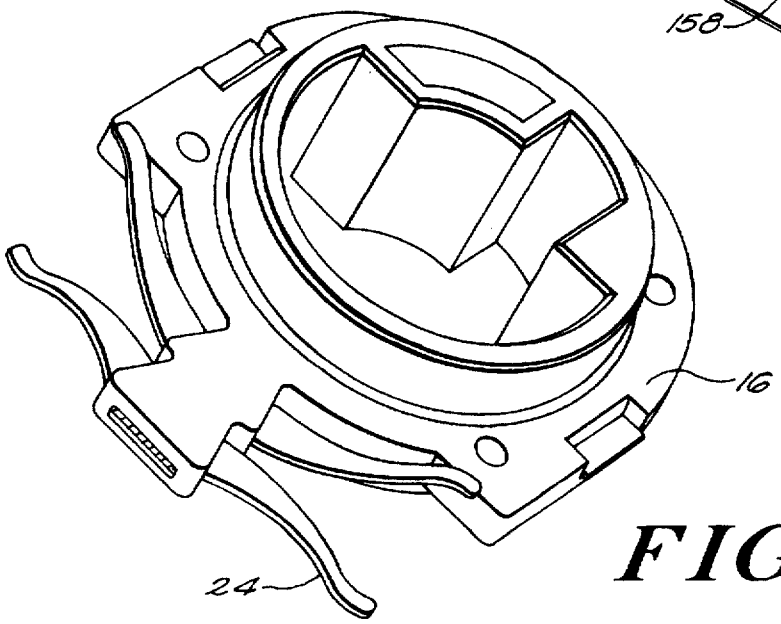
FIG. 14 is a perspective view of the rotor.

The rotor contact is stamped from a continuous strip of metal, as shown in FIG. 13. Prior to separation from the strip, the beams are bent upwardly or downwardly as appropriate. At this stage, each beam is over bent, or bent more than needed to contact its associated contact path, to ensure that it will have sufficient spring force to bias into contact with its associated contact path when assembled in the housing. Preferably the contact is formed from a highly electrically conductive material that also exhibits minimal stress relaxation over time, so that the beam does not lose contact with its associated stator contact. The beam is also plated with a suitable highly conductive material at the contact zone. After stamping and bending the beams, each contact is separated from the strip and placed into a mold for over molding into the rotor. An orientation feature 158 is provided extending inwardly from the circular portion of the rotor to ensure that the rotor contact is oriented properly in the mold. The orientation feature and the attachment element are provided on opposite sides for right-handed and left-handed versions.

The inner and outer housings 12, 14 are made of a dielectric insulative material. They are preferably made of the same material to facilitate sonic welding. The rotor body is also made of a dielectric insulative material, but to help ensure that it does not sonically weld to the inner and outer housing, it is made from a material different from that of the housings. The O-rings are made from a suitable elastomer and are typically lubricated with a lubricant.

The inner and outer housings, rotor, and O-rings are joined into a unitary assemblage by a suitable process, preferably sonic welding. The sonic welding apparatus includes a nest for holding the assemblage during the welding process and a sonic horn. The nest is arranged to receive the orientation feature of the rotor, so that left and right handed rotors can only be assembled one way and require separate nests. The sonic horn is configured to direct sonic energy to the outer circumferential joint between the inner and outer housings to join and seal the housings, while not directing energy to the rotor, since the rotor must remain free to rotate. A continuous bead of an electrical grease is applied around the inside of the inner housing. The grease prevents the contacts from oxidizing. The inner housing is loaded into the nest. The rotor, surrounded by the two O-rings, is seated in the inner housing. A continuous bead of electrical grease is applied around the inside of the outer housing. The outer housing is placed over the inner housing and rotor in proper alignment. The sonic horn is positioned over the assemblage and operated to weld the joint between the inner and outer housings. The assemblage is then removed from the nest. A lock assembly is then inserted through the openings in the two housings and the rotor and fastened thereto in any suitable manner, as by cooperative engagement with the latching tabs formed on the outer housing.

The rotary door lock switch of the present invention provides a number of advantages. The peripheral weld between the inner and outer housings provides an improved seal to keep out environmental contaminants and moisture. Although sonic welding is preferred, other mechanisms for providing an environmental seal between the two housings are possible. For example, a peripheral gasket may be provided in appropriately sized recesses between the two housings, and the housings may be joined by heat stakes. The internal configuration provided by the shoulders 40, 98 of the rotor and housings places the O-rings into positive displacement, which also improves sealing. Sealing is also improved at the wire entrance areas of the wire towers, which is achieved by the encapsulation of the wires in the towers created during the molding. The improved environmental sealing obviates the need to coat the assembly with an epoxy. The rotating contact beams are curved to provide dual radiussed surface contact and avoid contact at only the edges of the beams, thereby better maintaining electrical contact and avoiding gouging of the housing contacts. The curvature of the beams ensures a more uniform contact force on the housing contacts.

Although described in conjunction with a three-position switch, the advantages of the present invention are applicable to rotary switches incorporating only two positions. In this case, typically, one of the two inner contact pads is not used; it may or may not be present in the assembly. Similarly, the contact paths could be reversed, such that the two contact pads could be located on the outer contact path and the continuous contact on the inner contact path if desired.

The invention is not to be limited by what has been particularly shown and described, except as indicated by the appended claims.

I claim:

1. A rotary switch assembly comprising:

a first housing formed from a dielectric insulative material comprising a plate-like first stator member defining a first arcuate contact path and having a first opening therein, and a first wire tower integrally formed with the first stator member;

a first electrical contact including a first conductive pad disposed on a portion of the first arcuate contact path and a first wire grip crimped to a wire disposed within the first wire tower;

a second housing formed from a dielectric insulative material comprising a plate-like second stator member defining a second arcuate contact path concentric with the first arcuate contact path and having a second opening therein, and a second wire tower integrally formed with the second stator member;

a second electrical contact including a second conductive pad disposed on a portion of the second arcuate contact path and a second wire grip crimped to a wire disposed within the second wire tower;

a rotor comprising a rotor body and a rotor contact disposed within the rotor body, the rotor body disposed for rotation between the first housing stator member and the second housing stator member within the openings therein, the rotor body having an opening therein concentric with the first and second openings in the first and second housing stator members and sized to receive a lock assembly, the rotor contact including a pair of first contact beams disposed for electrical contact with the first conductive pad and a pair of second contact beams disposed for electrical contact with the second conductive pad; and the first and second housings being fixedly joined about a peripheral joint, the first and second housings being sealed sufficiently to prevent entry of environmental contaminants and moisture at the peripheral joint, at wire entrance areas, and between the rotor and the first and second housings.

2. The rotary switch assembly of claim 1, wherein the peripheral joint between the first housing and the second housing is a sonically welded joint.

3. The rotary switch assembly of claim 1, wherein:

the first housing includes a first recess concentrically formed about the first opening, and a first O-ring is disposed in sealing relationship against the first recess between the first housing and the rotor body; and the second housing includes a second recess concentrically formed about the second opening, and a second O-ring is disposed in sealing relationship against the second recess between the second housing and the rotor body.

4. The rotary switch assembly of claim 1, wherein the first housing and the second housing are formed of a same insulative material.

5. The rotary switch assembly of claim 4, wherein the rotor body is formed of a dielectric insulative material different from the insulative material of the first and second housings.

6. The rotary switch assembly of claim 1, further comprising a third contact including a third contact pad disposed on another portion of the first contact path and a third wire grip crimped to another wire disposed within a third wire tower, the third wire tower integrally formed with the first housing.

7. The rotary switch assembly of claim 1, further comprising a third electrical contact including a third conductive pad disposed on another portion of the second contact path and a third wire grip crimped to another wire disposed within a third wire tower, the third wire tower integrally formed with the second housing.

8. The rotary switch assembly of claim 1, wherein each of the contact beams of the rotor contact includes a contact zone curved in two directions for electrical contact with an associated conductive pad.

9. The rotary switch assembly of claim 1, wherein edges of each of the contact beams are upturned adjacent a beam tip.

10. The rotary switch assembly of claim 1, wherein each of the contact beams of the rotor contact includes two oppositely curved portions.

11. A method for forming a rotary switch assembly comprising:

forming a first housing assembly comprising:

providing a first electrical contact from an electrically conductive material, the first electrical contact comprising a first conductive pad and a first wire grip crimped to a wire;

providing a first mold having a first mold cavity configured to provide a plate-like stator member and a wire tower;

placing the first electrical contact in the first mold cavity with the first conductive pad within the plate-like stator member and the wire grip within the wire tower;

sealing the first mold at the wire tower;

filling the first mold cavity with a first dielectric insulative material;

allowing the dielectric insulative material to cure, whereby the first electrical contact becomes embedded in the dielectric insulative material to form the first housing assembly;

forming a second housing assembly, comprising:

providing a second electrical contact from an electrically conductive material, the second electrical contact comprising a second conductive pad and a second wire grip crimped to a second wire;

providing a second mold having a second mold cavity configured to provide a plate-like stator member and a wire tower;

placing the second electrical contact in the second mold cavity with the second conductive pad within the second plate-like stator member and the second wire grip within the second wire tower;

sealing the second mold at the second wire tower;

filling the second mold cavity with a second dielectric insulative material;

allowing the dielectric insulative material to cure, whereby the second electrical contact becomes embedded in the dielectric insulative material to form the second housing assembly;

forming a rotor comprising a rotor body and rotor contact;

placing the rotor for rotation between the first housing assembly and the second housing assembly; and sealing the first housing assembly and the second housing assembly about a peripheral joint.

12. The method of claim 11, wherein the step of sealing the first housing assembly and the second housing assembly comprises sonically welding the first housing assembly and the second housing assembly about the peripheral joint.

13. The method of claim 11, wherein the first dielectric insulative material and the second dielectric insulative material are identical.

14. The method of claim 13, wherein the rotor body is formed of a dielectric insulative material which is different from the first dielectric insulative material and the second dielectric insulative material.

15. The method of claim 11, wherein the steps of sealing the first and second molds at the wire tower each comprise pinching the wire between mold pieces sufficiently to prevent escape of the insulative material filling the first or second mold cavity.

16. A rotary switch assembly comprising:

a first housing formed from a dielectric insulative material comprising a plate-like first stator member defining a first arcuate contact path and having a first opening therein, and a first wire tower integrally formed with the first stator member;

a first electrical contact including a first conductive pad disposed on a portion of the first arcuate contact path and a first wire grip crimped to a wire disposed within the first wire tower;

a second housing formed from a dielectric insulative material comprising a plate-like second stator member defining a second arcuate contact path concentric with the first arcuate contact path and having a second opening therein, and a second wire tower integrally formed with the second stator member;

a second electrical contact including a second conductive pad disposed on a portion of the second arcuate contact path and a second wire grip crimped to a wire disposed within the second wire tower;

a rotor comprising a rotor body and a rotor contact disposed within the rotor body, the rotor body disposed for rotation between the first housing stator member and the second housing stator member within the openings therein, the rotor body having an opening therein concentric with the first and second openings in the first and second housing stator members and sized to receive a lock assembly, the rotor contact including a pair of first contact beams disposed for electrical contact with the first conductive pad and a pair of second contact beams disposed for electrical contact with the second conductive pad, each beam includes a contact zone curved in two directions for electrical contact with an associated conductive pad.

17. The rotary switch assembly of claim 16, wherein the edges of each of the contact beams are upturned.

18. The rotary switch assembly of claim 16, wherein each of the contact beams includes two oppositely curved portions.

* * * * *